US005444436A

United States Patent [19]

Kennison

[11] Patent Number: 5,444,436

[45] Date of Patent: Aug. 22, 1995

[54] FURNACE AND AIR CONDITIONER FAILURE ALARM APPARATUS

[76] Inventor: Ricky R. Kennison, 4728 N. Bristol, Kansas City, Mo. 64117

[21] Appl. No.: 175,234

[22] Filed: Dec. 29, 1993

[51] Int. Cl.[6] ..... G08B 21/00

[52] U.S. Cl. ..... 340/635; 340/584; 236/94; 165/11.1

[58] Field of Search ..... 340/584, 506, 507, 635; 236/94, DIG. 2, DIG. 3, 91 F; 165/11.1, 22; 110/193

[56] References Cited

U.S. PATENT DOCUMENTS

| | | | |
|---|---|---|---|
| D. 275,842 | 10/1984 | Gilbert et al. | 340/584 |
| 3,475,750 | 10/1969 | Howell et al. | 340/584 |
| 3,636,540 | 1/1972 | Harris | 340/519 |
| 3,636,560 | 1/1972 | Schoenwitz | 340/506 |
| 3,871,443 | 3/1975 | Jones | 165/11.1 |
| 4,240,077 | 12/1980 | Hughes et al. | 236/94 |
| 4,308,911 | 1/1982 | Mandl | 340/506 |
| 4,352,349 | 10/1982 | Yoho | 165/11.1 |
| 4,373,662 | 2/1983 | Bassett et al. | 165/11.1 |
| 4,381,549 | 4/1983 | Stamp, Jr. et al. | 165/11.1 |
| 4,433,809 | 2/1984 | Schulz | 165/11.1 |
| 4,616,485 | 10/1986 | Gillett et al. | 165/11.1 |
| 4,623,969 | 11/1986 | Bensoussan et al. | 165/11.1 |
| 4,644,478 | 2/1987 | Stephens et al. | 340/506 |
| 4,801,922 | 1/1989 | Worrell et al. | 340/586 |
| 4,815,657 | 3/1989 | Tsukuda | 165/11.1 |
| 4,853,693 | 8/1989 | Eaton-Williams | 236/94 |
| 4,858,824 | 8/1989 | Matsuda et al. | 236/94 |
| 4,864,283 | 9/1989 | Seto | 340/584 |
| 4,881,686 | 11/1989 | Mehta | 236/94 |
| 5,127,575 | 7/1992 | Beerbaum | 165/11.1 |
| 5,161,606 | 11/1992 | Berkeley et al. | 165/11.1 |
| 5,197,666 | 3/1993 | Wedekind | 165/11.1 |

*Primary Examiner*—Jeffery A. Hofsass

[57] ABSTRACT

A new and improved failure alarm apparatus is provided for a furnace and an air conditioner which selectively, alternately share a common thermostat. The furnace and air conditioner failure alarm apparatus includes a battery power supply for powering electrical circuits in case of AC power failure. A first sensor assembly circuit monitors thermostat status and is connected to a thermostat on a neutral wire (white wire) connected to the thermostat. Each of a second and third sensor assembly includes a respective temperature sensor and a respective temperature sensor circuit. A second temperature sensor is placed adjacent to an air duct outlet. In addition, a third temperature sensor (an environmental temperature sensor) is housed in the furnace and air conditioner failure assembly housing where the signal processing an alarm circuitry are housed. A signal processing assembly receives signals from the sensor circuit assemblies and processes the signals, and an alarm circuit assembly is connected to the signal processing assembly for providing an alarm when the signal processing assembly indicates an alarm condition. The air duct outlet is a register. The signal processing assembly may be connected to a home security alarm system. The first sensor assembly includes an electric voltage sensor. The electric voltage sensor is a 74121 one-shot multivibrator or monostable multivibrator. The second and third sensor assemblies include temperature sensors. The temperature sensors include thermistors. A power failure alarm assembly is connected to the battery power supply, for providing an alarm in the event of an AC power failure.

7 Claims, 7 Drawing Sheets

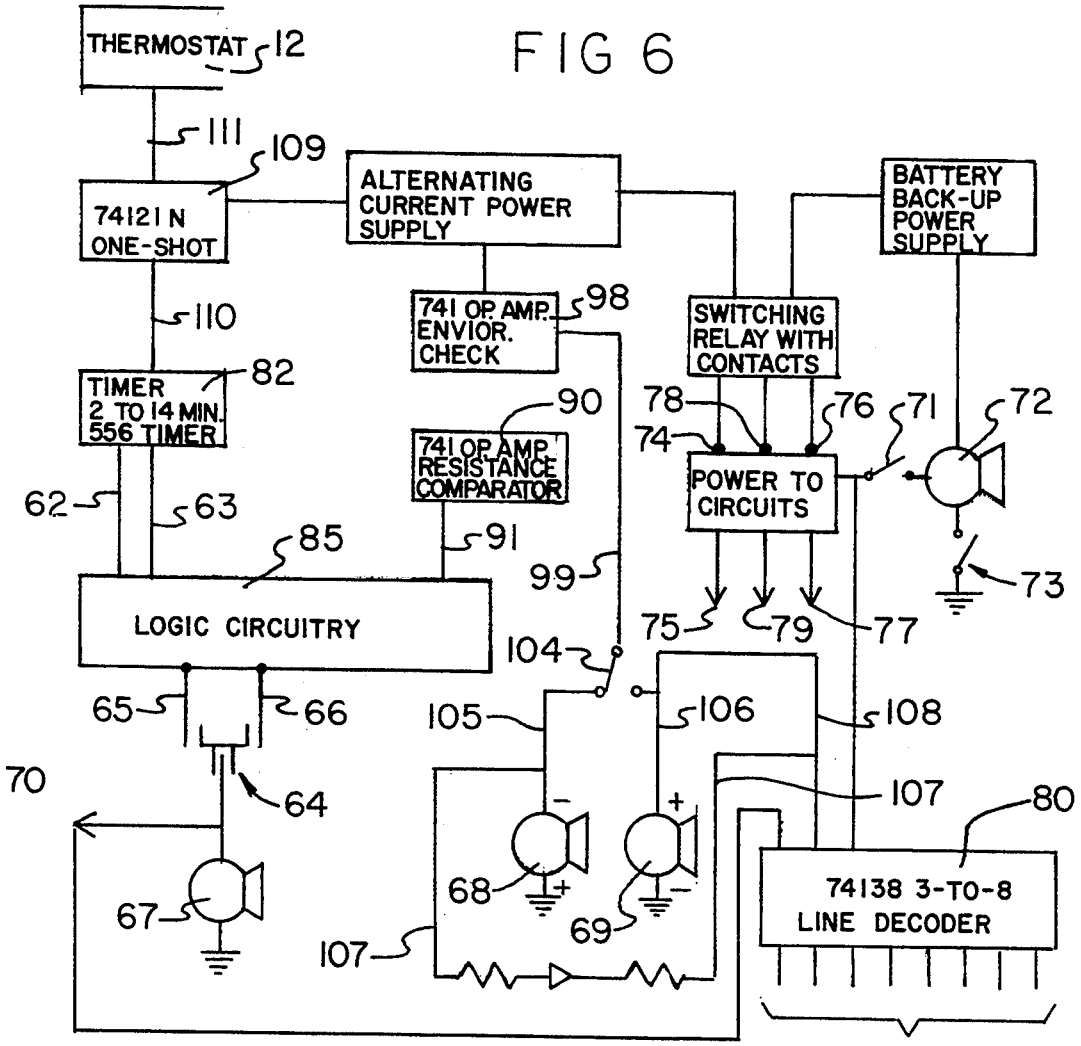
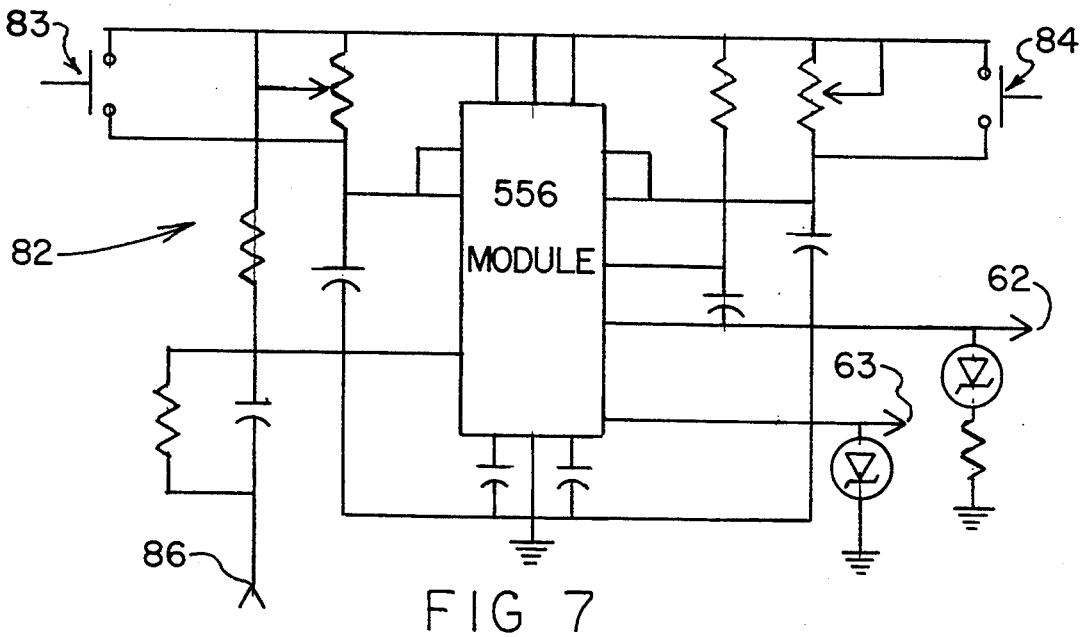
FIG 7

FURNACE AND AIR CONDITIONER FAILURE ALARM APPARATUS

BACKGROUND OF THE INVENTION

1. Field of the Invention

The present invention relates generally to furnace and air conditioner systems, and more particularly to devices for monitoring the status of furnace and air conditioner systems which may also include refrigeration systems.

2. Description of the Prior Art

Throughout the years, a number of innovations have been developed relating to the heating and cooling of the interior spaces of residential and commercial buildings, and the following U.S. patents are representative of some of those innovations: U.S. Pat. Nos. 3,475,750; 3,636,540; 4,801,922; 4,864,283; and Des. 275,842. More specifically, U.S. Pat. No. 3,475,750 appears to disclose a temperature monitoring system which sequentially monitors the temperature in a plurality of different locations and provides an alarm if the temperature at one of the monitored locations is out of specifications. This system does not monitor the proper functioning of the heating or cooling system. It only monitors the temperatures of the living spaces heated or cooled thereby. In this respect, it would be desirable if a device combined with a heating and cooling system were provided which monitored the proper functioning of the heating or cooling system.

U.S. Pat. No. 3,636,540 discloses a temperature control and alarm system that includes a sensor that is placed in direct contact with a furnace and that directly monitors the temperature of the furnace. The device provides an alarm when the temperature of the furnace is out of specifications. In a building that is not originally provided with a furnace having this temperature control and alarm system, to retrofit the building with this system, it would be quite a difficult task to run a wire from a room in which the thermostat for controlling the furnace is located and to attach a temperature to the furnace. In this respect, it would be desirable if a device combined with a heating and cooling system were provided which enabled monitoring of proper functioning of the heating and cooling system without connecting a sensor to a furnace and without running a new wire to the furnace.

U.S. Pat. No. 4,801,922 discloses a low temperature alarm which is triggered when the temperature measured at a particular location is out of prescribed specifications. This device does not monitor proper functioning of the heating and cooling system. When environmental factors are extreme, such as extreme cold weather or extreme hot weather, this alarm could be triggered even when the heating and cooling system is operating properly. In this respect, it would be desirable if a device combined with a heating and cooling system were provided which did not trigger an alarm merely as a result of extremely cold or extremely hot weather.

U.S. Pat. No. 4,864,283 discloses a temperature alarm that has its own dedicated thermostat for controlling the alarm. This device does not employ the in place thermostat that is present in the heating and cooling system. This system requires the added expense of using an additional thermostat. Furthermore, it does not monitor the functioning of the heating and cooling system. In this respect, it would be desirable if a device combined with a heating and cooling system were provided which used the thermostat in place in the heating and cooling system and does not need an additional thermostat.

U.S. Pat. No. Des. 275,842 discloses another temperature level alarm that merely monitors the temperature of an interior space. It does not monitor the functioning of the heating and cooling system.

Furnaces and air conditioner seldom fail, but if they do, the results can be extremely undesirable. A failed heating system can cause the temperature in a building to fall to unsafe levels. A failed air conditioner can cause the temperature in the building to rise to unsafe levels. Any equipment that is designed to operate in a predetermined temperature range may not operate properly in the event of furnace or air conditioner failure. These facts provide additional reasons for monitoring the proper functioning of the heating or cooling system. When the heating or cooling system is not operating properly, then an alarm should indicate this failure in proper function. In this respect, it would be desirable if a device combined with a heating and cooling system provides an alarm when the heating or cooling system were not functioning properly.

Thus, while the foregoing body of prior art indicates it to be well known to use alarms to indicate temperatures outside a specified range, the prior art described above does not teach or suggest a furnace and air conditioner failure alarm apparatus which has the following combination of desirable features: (1) monitors the proper functioning of the heating or cooling system; (2) enables monitoring of proper functioning of the heating and cooling system without connecting a sensor to a furnace and without running a new wire to the furnace; (3) does not trigger an alarm merely as a result of extremely cold or extremely hot weather; (4) uses the thermostat in place in the heating and cooling system and does not need an additional thermostat; and (5) provides an alarm when the heating or cooling systems are not functioning properly. The foregoing desired characteristics are provided by the unique furnace and air conditioner failure alarm apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved failure alarm apparatus is provided for a furnace and an air conditioner which selectively, alternately share a common thermostat. The furnace and air conditioner failure alarm apparatus includes a battery power supply for powering electrical circuits in case of AC power failure. A sensor circuit assembly includes a first sensor assembly which monitors the status of a thermostat and is connected to a neutral wire (white wire) connected to a thermostat. A second and a third sensor assembly includes a temperature sensor and temperature sensor circuitry. One temperature sensor (for the second sensor assembly) is placed adjacent to an air duct outlet, and a second temperature sensor (for the third sensor assembly) is placed in the furnace and air conditioner failure alarm housing. The third sensor assembly is an environmental temperature sensor for the furnace and air conditioner failure alarm housing. A signal processing assembly receives signals from the .sensor circuit assembly and for processes the signals, and an alarm circuit assembly is connected to the signal processing assembly for providing an alarm when the signal processing assembly indicates an alarm condition. The air duct outlet is a register. The signal processing assembly may be connected to a home security alarm system.

The first sensor assembly includes electric voltage sensors. The second and third sensor assemblies include respective temperature sensors. Each temperature sensor includes a thermistor.

A power failure alarm assembly is connected to the battery power supply, for providing an alarm in the event of an AC power failure.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved furnace and air conditioner failure alarm apparatus which has all of the advantages of the prior art and none of the disadvantages.

It is another object of the present invention to provide a new and improved furnace and air conditioner failure alarm apparatus which may be easily and efficiently manufactured and marketed.

It is a further object of the present invention to provide a new and improved furnace and air conditioner failure alarm apparatus which is of durable and reliable construction.

An even further object of the present invention is to provide a new and improved furnace and air conditioner failure alarm apparatus which is susceptible of a low cost of manufacture with regard to both materials and labor, and which accordingly is then susceptible of low prices of sale to the consuming public, thereby making such furnace and air conditioner failure alarm apparatus available to the buying public.

Still yet a further object of the present invention is to provide a new and improved furnace and air conditioner failure alarm apparatus which monitors the proper functioning of the heating or cooling system.

Still another object of the present invention is to provide a new and improved furnace and air conditioner failure alarm apparatus that enables monitoring of proper functioning of the heating and cooling system without connecting a sensor to a furnace and without running a new wire to the furnace.

Yet another object of the present invention is to provide a new and improved furnace and air conditioner failure alarm apparatus which does not trigger an alarm merely as a result of extremely cold or extremely hot weather.

Even another object of the present invention is to provide a new and improved furnace and air conditioner failure alarm apparatus that uses the thermostat in place in the heating and cooling system and does not need an additional thermostat.

Still a further object of the present invention is to provide a new and improved furnace and air conditioner failure alarm apparatus which provides an alarm when the heating or cooling systems are not functioning properly.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 6 is a block diagram for the overall circuitry of the furnace and air conditioner failure alarm apparatus of the invention.

FIG. 7 is a detailed electrical schematic diagram for the timer assembly shown in FIG. 6.

DESCRIPTION OF THE PREFERRED EMBODIMENT

With reference to the drawings, a new and improved furnace and air conditioner failure alarm apparatus embodying the principles and concepts of the present invention will be described.

Figure 1:
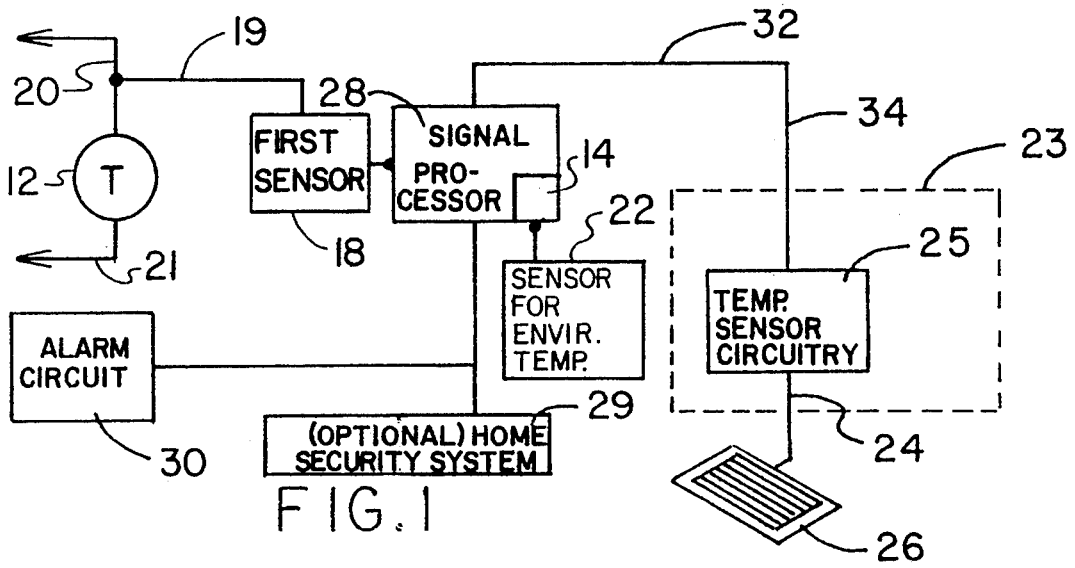
FIG. 1 is an electrical block diagram of an embodiment of the furnace and air conditioner failure alarm apparatus of the invention.

Turning initially to FIG. 1, there is shown a block diagram for a preferred embodiment of the failure alarm apparatus for a furnace and an air conditioner which selectively, alternately share a common thermostat 12. The furnace and air conditioner failure alarm apparatus includes a battery power supply 14 for powering electrical circuits in case of AC power failure. A first sensor circuit assembly 18 monitors the status of the thermostat 12 and is connected by a wire 19 to the neutral wire 20 connected to the thermostat 12. The thermostat 12 is connected by wire 21 to other conventional thermostat circuitry. A second sensor assembly 23 includes a temperature sensor 24 and temperature sensor circuitry 25. The temperature sensor 24 placed adjacent to an air duct outlet 26. A third sensor 22 checks the environmental temperature in the furnace and air conditioner failure assembly housing where the signal processing and alarm circuitry are housed.

A signal processing assembly 28 receives signals from the sensor circuit assemblies and processes the signals, and an alarm circuit assembly 30 is connected to the signal processing assembly for providing an alarm when the signal processing assembly indicates an alarm condition. A wire 32 runs from the signal processing assembly 28 to a wire 34 which may run under a floor or over a ceiling. The wire 34 running from the wire 32 to the second sensor assembly 23 may run behind a wall. The air duct outlet is a register. The signal processing assembly 28 may be connected to a home security alarm system 29.

The first sensor assembly is connected to the neutral wire 20 (white wire) connected to the thermostat 12 and senses a voltage swing in the wire 20 when the thermostat moves from an open to closed position or vice versa. The second sensor assembly includes a thermistor which serves as a temperature sensor, and the third sensor assembly also includes a thermistor which serves as a temperature sensor. The temperature sensor includes a thermistor.

Figure 2:
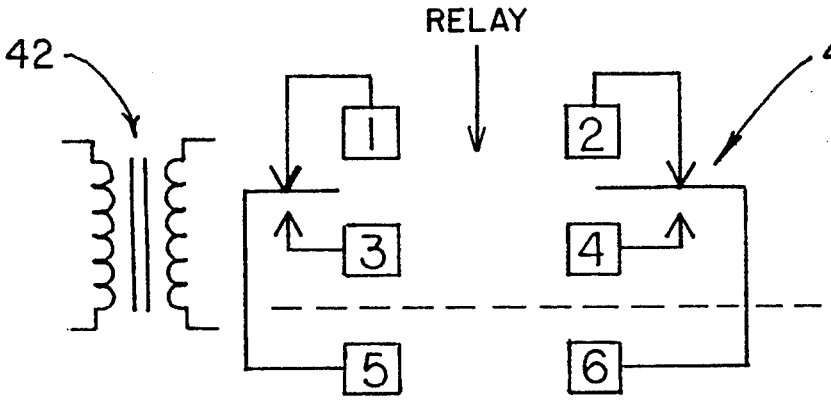
FIG. 2 is an electrical schematic diagram of a power relay used with the embodiment of the invention shown diagrammatically in FIG. 1.

A power failure alarm assembly 40 is connected to the battery power supply 14, for providing an alarm in the event of an AC power failure. As shown in FIG. 2, power relay 42 is connected to AC power. The relay is a double-pole relay. Pins 1 and 2 of the relay go to −12 VDC and +12 VDC, respectively, from battery power supply 14. Pins 3 and 4 of the relay come from −5 VDC and +5 VDC, respectively, from a power supply. Pins 5 and 6 go to +VCC (+5 VDC) and −VCC (−5 VDC), respectively. The ground on the power supply is common for the circuit.

Figure 3:
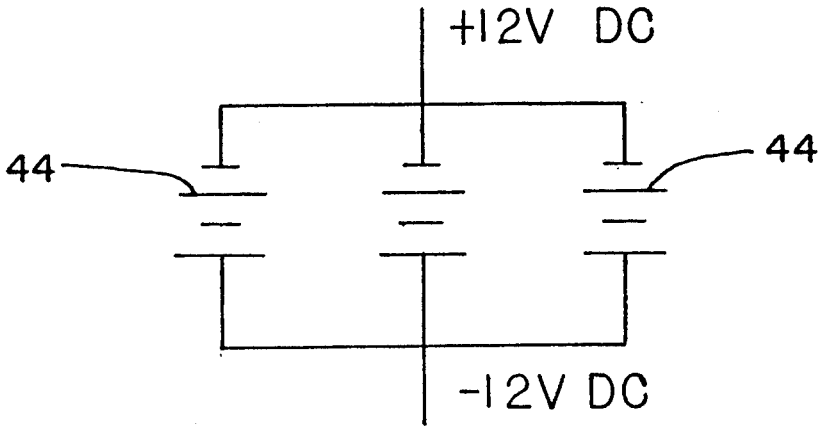
FIG. 3 is an electrical schematic diagram of a back up battery supply.

As shown in FIG. 3, the battery power supply 14 backup includes three sets of two Duracell No. 304116 12.6 volt batteries 44 connected together to form a 12 VDC power source.

Figure 4:
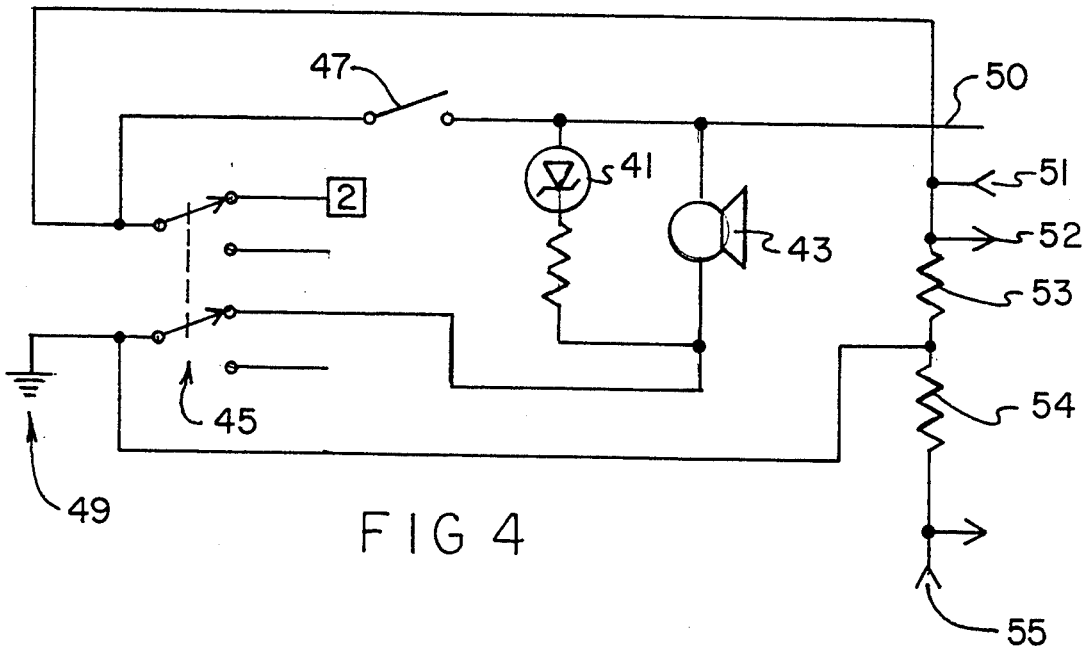
FIG. 4 is an electrical schematic diagram which includes a relay control, DC battery back-up power supply, and power failure alarm.

In FIG. 4, there is shown a relay control, DC battery back-up, power supply, and power failure alarm. More specifically. An LED 41 provides a visual alarm signal. A buzzer 43 provides an audible alarm signal. Pin 2 receives current from the relay in the form of +12 VDC battery voltage. DPDT slider switch 45 permits optional use of the circuit. Switch 47 is and off switch for the LED 41 and the buzzer 43. The ground 49 is the ground on the DC power supply (common). Line 50 connects to a 3 to 8 line decoder for home security system monitoring. Connector 51 connects to +12 VDC battery power. Line 52 connects to +5 VDC. Resistor 53 is 30 ohms. Resistor 54 is 15 ohms. Connector 55 connects to −12 VDC battery voltage. It is noted that unregulated DC battery power supply pulls down to + or −5 volts with null offset and adjusted for total circuit load.

The furnace and air conditioner failure alarm apparatus of the invention measures the air temperature of the furnace and air conditioner equipment and gives an alarm and notifies a home security system. The apparatus of the invention check to see if the output air temperature of the air conditioner gets too warm. The apparatus also checks the air output temperature of the furnace to see if it gets too cool. The apparatus checks the environmental room temperature to see if the room is getting too cool or too warm and then sounds an alarm and notifies the home security system. The apparatus monitors the electric power going to the furnace or air conditioner and sounds an alarm and notifies the home security system when the power fails to the other circuitry and equipment. More specifically, in operation, the thermistor senses the temperature of air that exits from the register. By sensing the temperature of air flowing out of a register, the invention provides for monitoring of the functioning of the furnace or air conditioner. The furnace and air conditioner failure alarm apparatus of the invention can also test for failure of the common thermostat for the furnace and the air conditioner. In addition, the furnace and air conditioner failure alarm apparatus of the invention cant sense the absence of normal electric power in a power failure.

To sense an electric power failure, the AC relay switches to battery power and sounds an alarm. To sense a temperature failure, the furnace and air conditioner failure alarm apparatus of the invention uses the temperature at the register to provide an alarm if the sensed temperature is either too hot or too cold. More specifically, the furnace and air conditioner failure alarm apparatus of the invention an approximately 10 volt battery power supply. Alternatively, an AC-DC converter can be employed to power the electronic circuitry. The respective sensors of the sensor circuit assembly provide signals to amplifiers to multiply the signal strengths. The 74121 one-shot multivibrator senses a swing in voltage at the neutral (white) wire connected to the thermostat and starts the timers to work.

The signal processing assembly includes logic gate circuitry. Signals received by the logic gate circuitry come from an electronic variable delay timer and from amplifiers which amplify signals from the 74121 one-shot, and from the third sensor assembly (the thermistor of the register sensor assembly).

Figure 5:
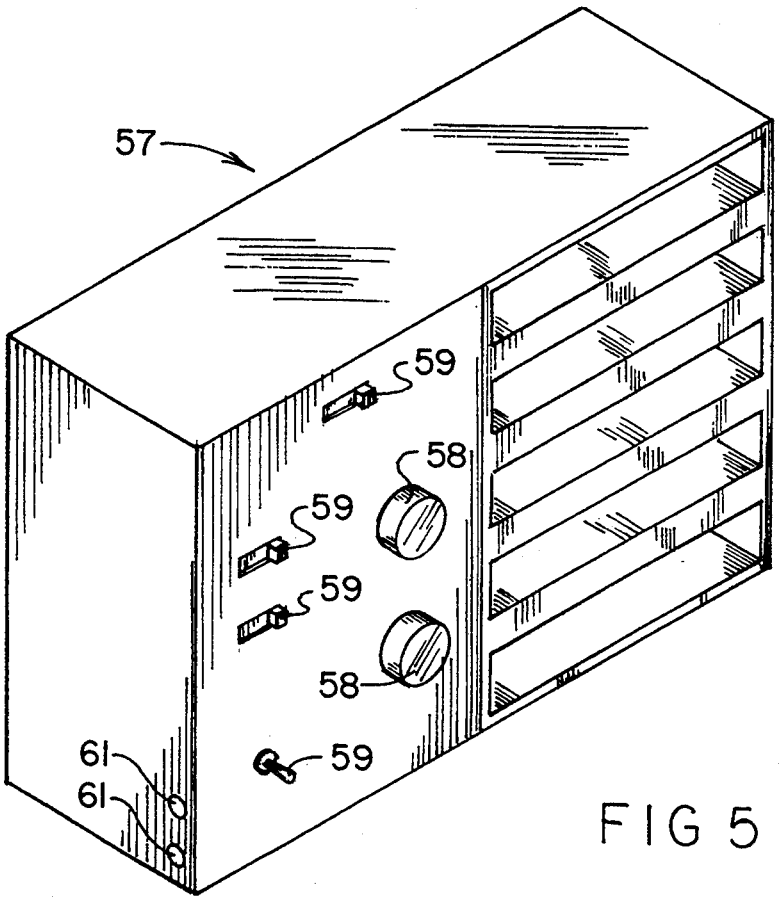
FIG. 5 is a perspective view of a housing that can house the circuitry of the invention.

In FIG. 5, a housing 57 is shown that can house the circuitry of the invention. Knobs 58 and switches 59 are provided for performing various electrical switching functions. Ports 61 are provided for permitting wire to pass through to connect to sensor assemblies of the invention.

An overall schematic diagram is shown in FIG. 6. Aside from blocks that are clearly labelled, FIG. 6 discloses a first timer line 62 and a second timer line 63 is connected to timer 82. A selector switch 64 enables selection between the furnace contact 65 and the air conditioner contact 66. An alarm buzzer 67 is provided as are other alarm buzzers 68 and 69. Alarm buzzers 68 and 69 may be piezo speakers. Output line 70 leads to a home security system. A buzzer off switch 71 is provided for buzzer 72. Another on/off switch 73 is also provided. Contacts 74 and 75 arc at +5 VDC. Contacts 75 and 77 are at −5 VDC. Contacts 78 and 79 are at ground potential. The three-input-line to eight-output-line decoder 80 converts a three bit input into an eight bit output for monitoring by a home security system.

FIG. 7 is a detailed electrical schematic diagram for the timer assembly 82 shown in FIG. 6. The timer assembly 82 is a standard 556 timer module. A normally open push button switch 83 is provided for zeroing one of the two timers in the timing module. A normally open push button switch 84 is provided for zeroing the second timer in the timing module. The first timer line 62 is connected to the logic circuitry 85. The second timer line 63 is also is connected to the logic circuitry 85. Line 86 is connected to a trigger in line. Both timers are connected in their one-shot mode. Grounding the trigger input 86 starts the first timer which then starts the second timer. It is noted that the first timer holds off the alarm until operation of the furnace and the air conditioner have reached operating temperatures. Then, the second timer comes on. This is where the specifications on the temperature of the output air are checked for alarm conditions. When the second timer goes off, the alarm can not arm on alert (can't sound) and resets the operation for the next time thermostat starts the sequence again.

Figure 8:
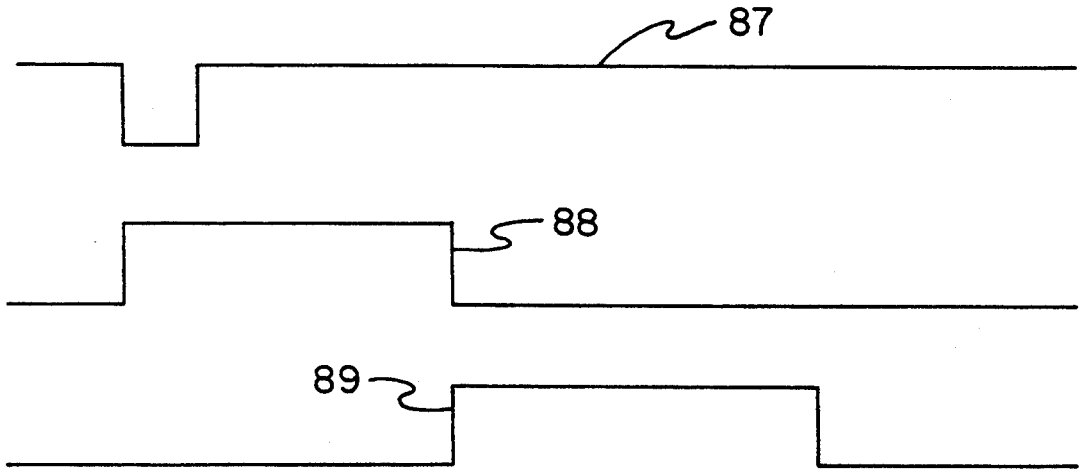
FIG. 8 shows three signal states compared for the same time period.

In FIG. 8, three signal states are compared for the same time period. Signal state curve 87 represents the signal state of the trigger line. Signal state curve 88 represents the signal state of the first timer line 62. Signal state curve 89 represents the signal state of the second timer line 63. The first timer can run for 16 minutes, and the second timer can run for 20 minutes.

Figure 9:
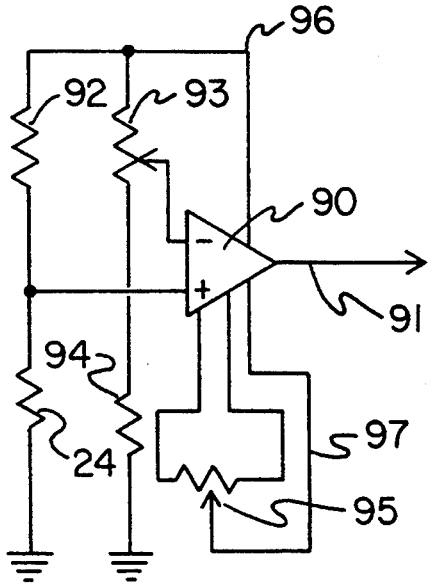
FIG. 9 is an electrical schematic diagram of an operational amplifier and its associated circuitry including an output line connected to the logic circuitry, wherein the amplifier is used to monitor the specifications on the outlet air temperature coming from the furnace or air conditioner.

In FIG. 9, operational amplifier assembly 90 and its associated circuitry are shown, includes output line 91 is connected to the logic circuitry 85. The amplifier assembly 90 is used to monitor the specifications on the outlet air temperature coming from the furnace or air conditioner. Thermistor 24 is employed in the circuitry. Resistors 24, 92, 93, and 94 are selected until the value of the sum of resistors 24 and 92 equals the value of the sum of resistors 93 and 94. Resistor 95 is used to adjust null offset. Line 96 receives +5 VDC, and line 97 receives −5 VDC. The output on line 91 can be set by varying resistor 93 to set the temperature monitored for either air conditioning or heat from the furnace. This monitors the air conditioner or furnace operating output temperatures.

Figure 10:
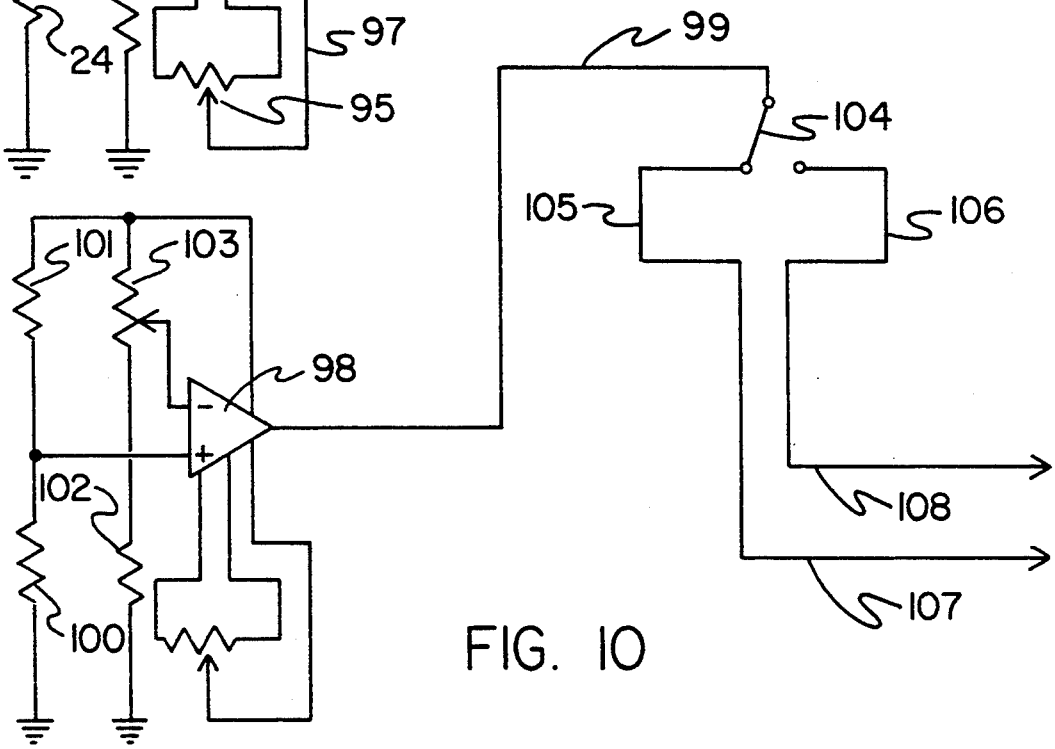
FIG. 10 is an electrical schematic diagram of an operational amplifier and its associated circuitry, wherein the amplifier is used to monitor the specifications on the environmental room temperature.

In FIG. 10, operational amplifier 98 and its associated circuitry are shown, includes output line 99. Operational amplifier 98 is used for monitoring environmental room temperature. Resistors 100, 101, 102, and 103 are selected so that the value of the sum of resistors 100 and 101 is equal to the value of the sum of resistors 102 and 103. Resistor 100 is a thermistor whose resistance varies with temperature. Resistor 103 may be varied to monitor temperature for environmental room conditions for either environmental air conditioning or environmental heating. Output switch 104 is used as a selection switch for monitoring either the furnace, for line 105, or for monitoring the air conditioner for line 106.

In FIGS. 9 and 10, the operational amplifier is set for 65 deg. F. of resistance variable for an air conditioner running condition. The operational amplifier is set for 85 deg. F. of resistance variable for a furnace running condition. The operational amplifier is set for 85 deg. F. of resistance variable for an air conditioner and furnace no run condition. The operational amplifier is also set for 65 deg. F. of resistance variable of an air conditioner and furnace no run condition.

Figure 11:
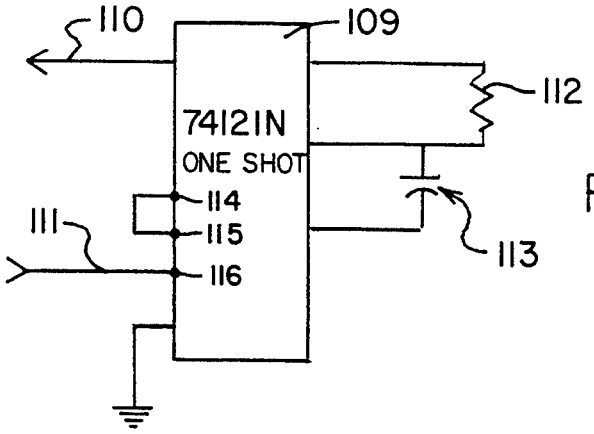
FIG. 11 is an electrical schematic diagram of the 74121 one-shot multivibrator module and its associated circuitry.

In FIG. 11, an electrical schematic diagram of the 74121 one-shot multivibrator module 109 and its associated circuitry is shown. Line 110 connects to the timer module 82 to start the first timer. Line 111 connects to the white wire post (the neutral post) on the thermostat 12 wiring. This connection allows a negative spike input when the thermostat changes from closed to open then closed. It is noted that the 74121 one-shot module 109 is a complete monostable multivibrator except for an external timing resistor 112 and capacitor 113. There are three gated inputs 114, 115, and 116 corresponding to pin positions 3, 4, and 5, respectively. The input gain equation for triggering is T=((not)3+(not)4)5, where pin 5 is a Schmitt trigger gate input. This allows the pin 5 input to respond to a slow going positive input voltage, for example a low-frequency sine-wave input.

Figure 12:
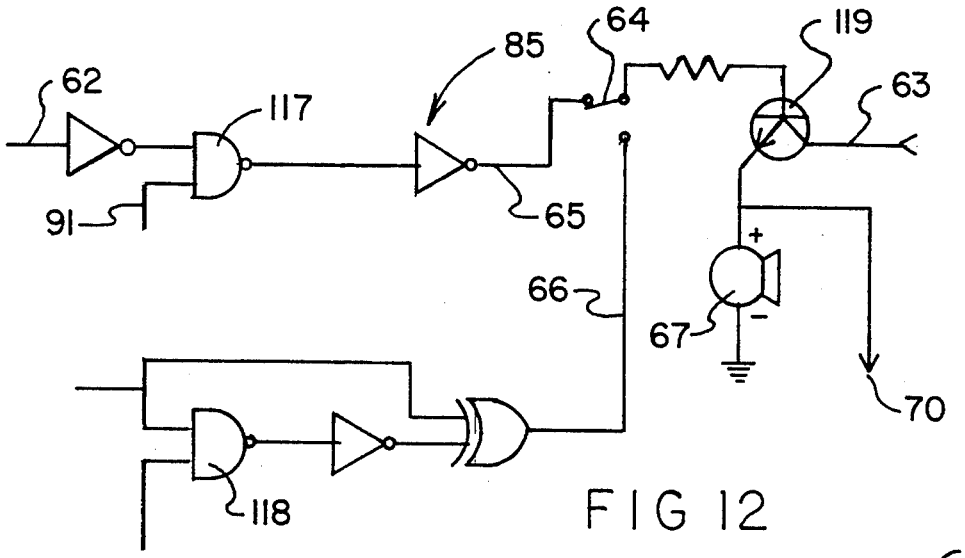
FIG. 12 is a block diagram of components of the logic circuitry.

In FIG. 12, a block diagram of components of the logic circuitry 85 is shown. Logic chips 7400N, 7400N, and 7486N are used. Line 62 is from the timer module 82. Line 91 is from the Op. Amp. assembly 90. The NAND gate 117 is used when the system is in an air conditioning mode. The NAND gate 118 is used when the system is in a furnace (heating) mode. Switch 64 is used to select either the air conditioning mode or the heating mode. In the air conditioning mode, the Op. Amp. assembly 90 is set for the desired specifications for temperatures of output air conditioned air. In the furnace mode, the Op. Amp. assembly 90 is set for the desired specifications for temperatures of output heated air. Line 63 connects to the timer module 82. The NPN switching transistor 2N2222A, reference numeral 119, is used for switching from the furnace mode to the air conditioning mode, and vice versa. Output line 70 leads to the three-input-line to eight-output-line decoder 80 of the home security system.

Figure 13:
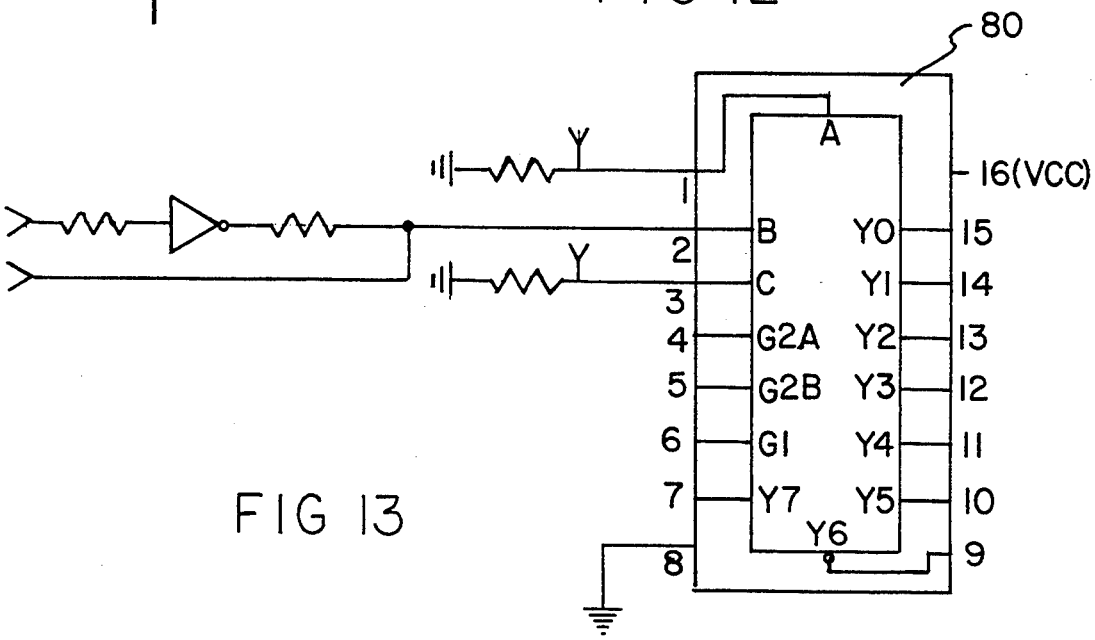
FIG. 13 is a detailed schematic diagram of the three-input-line to eight-output-line decoder.

In FIG. 13, a detailed schematic diagram of the three-input-line to eight-output-line decoder 80 is shown.

The truth table presented below is applicable to the implementation of the three-input-line to eight-output-line decoder 80 used in this embodiment of the invention. Input A is for input of temperature specifications on furnace and air conditioner alarm. Input B is or input of environmental room temperature alarm. One of the two inputs is for hot and the other is for cold. Input C is for input of power failure to furnace and air conditioner alarm. Outputs are sent to the home security system microprocessor for processing. The 74138 is used here as a 3-6-8 line decoder for sending signals to the home security, monitoring system of failures on the furnace and air conditioner temperature specifications, the environmental temperature specifications, and the presence of power to furnace and air conditioner equipment. The outputs are processed the input communication ports of the home security system microprocessor.

| Condition | Inputs C | B | A | Outputs |
|---|---|---|---|---|
| AH conditions O.K. | 0 | 0 | 0 | Y0 = 0; all others = 1 |
| heat/cool temp. failure | 0 | 0 | 1 | Y1 = 0; all others = 1 |
| environ. temp. failure | 0 | 1 | 0 | Y2 = 0; all others = 1 |
| all temps. failure | 0 | 1 | 1 | Y3 = 0; all others = 1 |
| power failure | 1 | 0 | 0 | Y4 = 0; all others = 1 |
| power and heat/cool fail. | 1 | 0 | 1 | Y5 = 0; all others = 1 |
| power and environ. temp. fai. | 1 | 1 | 0 | Y6 = 0; all others = 1 |
| all three alarm failures | 1 | 1 | 1 | Y7 = 0; all others = 1 |

Figure 14:
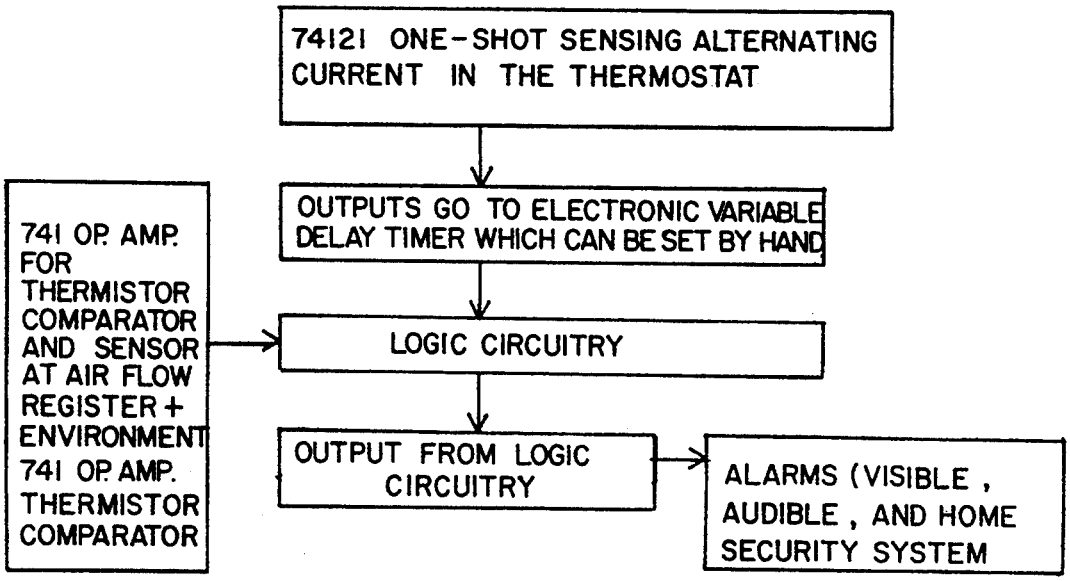
FIG. 14 is a partial block diagram depicting operation of the furnace and air conditioner failure alarm apparatus of the invention.

In FIG. 14, a partial block diagram of operation of the furnace and air conditioner failure alarm apparatus of the invention is shown as explained above.

Figure 15:
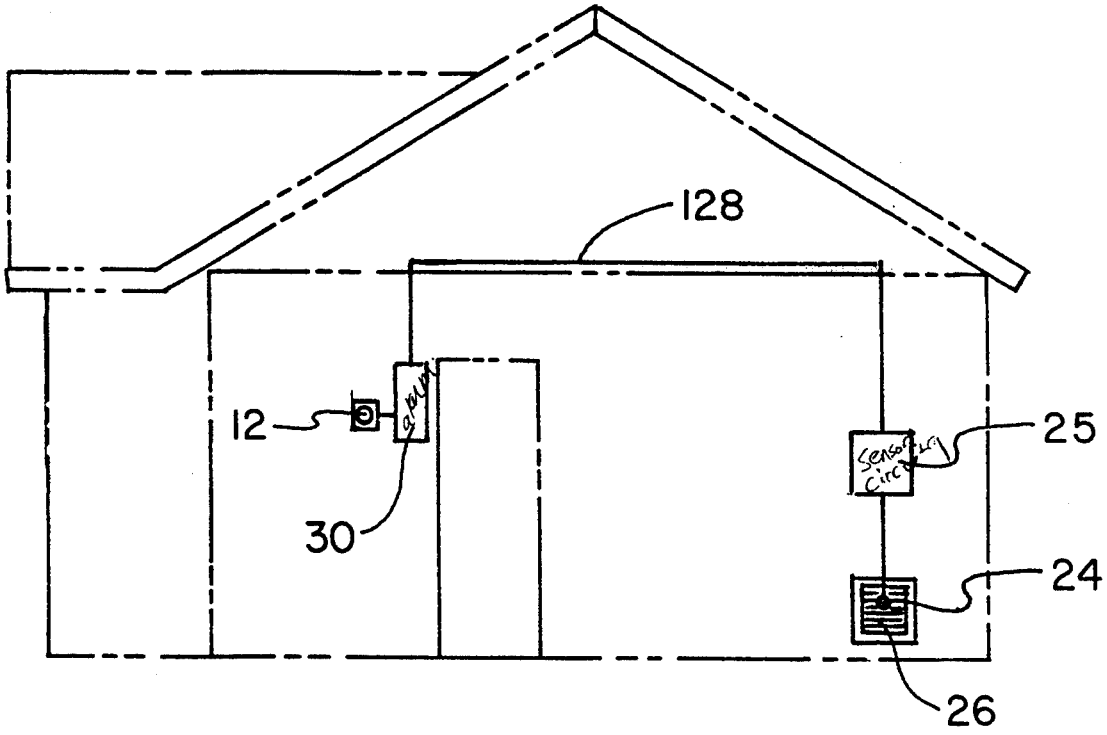
FIG. 15 shows a pictorial diagram of an embodiment of the furnace and air conditioner failure alarm apparatus of the invention installed near a thermostat and a room register.

FIG. 15 shows pictorial diagram of an embodiment of the furnace and air conditioner failure alarm apparatus of the invention installed near a thermostat 12 and a register 26. A portion of the wires 128 run through the attic of the house and a portion run through the walls of the house.

The components of the furnace and air conditioner failure alarm apparatus of the invention can be made from inexpensive and durable readily available electronic components.

As to the manner of usage and operation of the instant invention, the same is apparent frown the above disclosure, and accordingly, no further discussion relative to the manner of usage and operation need be provided.

It is apparent from the above that the present invention accomplishes all of the objects set forth by providing a new and improved furnace and air conditioner failure alarm apparatus that is low in cost, relatively simple in design and operation, and which may advantageously be used to monitor the proper functioning of the heating or cooling system. With the invention, a furnace and air conditioner failure alarm apparatus is provided which enables monitoring of proper functioning of the heating and cooling system without connecting a sensor to a furnace and without running a new wire to the furnace. With the invention, a furnace and air conditioner failure alarm apparatus is provided which does not trigger an alarm merely as a result of extremely cold or extremely hot weather. With the invention, a furnace and air conditioner failure alarm apparatus is provided which uses the thermostat in place in the heating and cooling system and does not need an additional thermostat. With the invention, a furnace and air conditioner failure alarm apparatus is provided which provides an alarm when the heating or cooling systems are not functioning properly.

Additional advantages are provided by the furnace and air conditioner failure alarm apparatus of the invention. Sick or elderly people may be given an alarm before a drastic temperature condition develops. At night, when everyone is asleep in bed, the alarm may warn people to wake up if the house gets too cold on winter nights or too hot on summer nights. When people would be away from home in winter time, the alarm can tell if the house is getting too cold before the water pipes break and cause water damage to the home. The alarm can sound or light up at the residence and could also send a signal to the home security system.

The home security system could warn the security company of furnace and air conditioner failure. After the security company is alarmed, they could call by phone and tell the home occupants about the occurrence of the failure. The phone call could be helpful at night when everyone is asleep and not able to perceive the temperature changes. It can also be helpful to give a phone call to sick or elderly persons to warn of the temperature failure.

In essence, the furnace and air conditioner failure alarm apparatus of the invention can be used much like a smoke detector is used, except it is used to monitor and signal temperature failures. The alarm will sense if the air conditioner is blowing warm air or if the furnace is blowing cool air or if there is no function of the furnace or the air conditioner, and the room gets too hot or too cold. The furnace and air conditioner failure alarm apparatus of the invention can be installed by heating-/cooling contractors, by do-it-yourselfers, and by home security device installers.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved failure alarm apparatus for a furnace and an air conditioner which selectively, alternately share a common thermostat, comprising:

a battery power supply for powering electrical circuits, a sensor circuit assembly powered by said battery power supply, said sensor circuit assembly including a first sensor assembly for monitoring the thermostat, wherein said first sensor assembly is connected to a wire which is connected to the thermostat, said sensor circuit assembly including a second sensor assembly which includes a temperature sensor and temperature sensor circuitry, said temperature sensor placed adjacent to an air duct outlet wherein said air duct outlet is a register in a room, a signal processing assembly for receiving signals from said sensor circuit assembly and for processing said signals, and an alarm circuit assembly connected to said signal processing assembly for providing an alarm when said signal processing assembly indicates an alarm condition based upon direct electrical monitoring of thermostat status from said sensors and processed signals from said direct monitoring which indicate improper thermostat operation.

2. The apparatus described in claim 1, further including:

a third sensor assembly which includes a temperature sensor for sensing environmental temperature in a housing which houses said alarm circuit assembly in a room.

3. The apparatus described in claim 1 wherein said third temperature sensor includes a thermistor.

4. The apparatus described in claim 1, further including:

a power failure alarm assembly, connected to said battery power supply, for providing an alarm in the event of an AC power failure.

5. The apparatus described in claim 1 wherein said signal processing assembly is connected to a home security alarm system.

6. A new and improved failure alarm apparatus for a furnace and an air conditioner which selectively, alternately share a common thermostats, comprising:

a battery power supply for powering electrical circuits, a sensor circuit assembly powered by said battery power supply, said sensor circuit assembly including a first sensor assembly for monitoring the thermostat, wherein said first sensor assembly is connected to a wire which is connected to the thermostat, said sensor circuit assembly including a second sensor assembly which includes a temperature sensor and temperature sensor circuitry, said temperature sensor placed adjacent to an air duct outlet wherein said air duct outlet is a register in a room, a signal processing assembly for receiving signals from said sensor circuit assembly and for processing said signals, and an alarm circuit assembly connected to said signal processing assembly for providing an alarm when said signal processing assembly indicates an alarm condition based upon direct electrical monitoring of thermostat status and processed signals from direct monitoring which indicate improper thermostat operation, wherein said first sensor assembly is connected to a neutral wire connected to the thermostat, and wherein said first sensor assembly includes means for sensing voltage swings over said neutral wire when the thermostat opens and closes.

7. The apparatus described in claim 6 wherein and said first sensor assembly includes a one-shot monostable multivibrator which senses a negative voltage spike when the thermostat changes from closed to open.

* * * * *